US010309645B2

(12) United States Patent
Tsuji et al.

(10) Patent No.: US 10,309,645 B2
(45) Date of Patent: Jun. 4, 2019

(54) GAS SUPPLY MANIFOLD AND GAS COMBUSTION DEVICE PROVIDED WITH THE SAME

(71) Applicant: NORITZ CORPORATION, Hyogo (JP)

(72) Inventors: Yuta Tsuji, Kobe (JP); Naoki Se, Kobe (JP); Hideyuki Fujisawa, Kobe (JP); Katsuya Imaoka, Kobe (JP); Keizo Kawano, Kobe (JP); Tatsuya Karaki, Kobe (JP); Ryosuke Umakoshi, Kobe (JP)

(73) Assignee: NORITZ CORPORATION, Hyogo (JP)

( * ) Notice: Subject to any disclaimer, the term of this patent is extended or adjusted under 35 U.S.C. 154(b) by 16 days.

(21) Appl. No.: 15/624,393

(22) Filed: Jun. 15, 2017

(65) Prior Publication Data

US 2017/0370574 A1 Dec. 28, 2017

(30) Foreign Application Priority Data

Jun. 24, 2016 (JP) ..... 2016-125930

(51) Int. Cl.
*F23D 14/04* (2006.01)
*F23D 14/02* (2006.01)
*F23D 14/06* (2006.01)

(52) U.S. Cl.
CPC ..... *F23D 14/06* (2013.01); *F23D 14/02* (2013.01); *F23D 14/04* (2013.01)

(58) Field of Classification Search
CPC ..... F23D 14/045; F23D 14/02
USPC ..... 431/354
See application file for complete search history.

(56) References Cited

U.S. PATENT DOCUMENTS

2011/0297059 A1* 12/2011 Shimizu ..... F23D 14/045 110/299
2012/0156629 A1* 6/2012 Akiyama ..... F23D 14/04 431/354
2012/0219920 A1* 8/2012 Akiyama ..... F23D 14/586 431/278
2012/0308945 A1* 12/2012 Wada ..... F23C 6/02 431/278
2013/0149653 A1* 6/2013 Fukunishi ..... F23D 14/02 431/278
2013/0171576 A1* 7/2013 Akiyama ..... F23D 14/02 431/354

(Continued)

FOREIGN PATENT DOCUMENTS

JP 2003-065507 A 3/2003
JP 2004-197971 A 7/2004

*Primary Examiner* — Steven B McAllister
*Assistant Examiner* — Desmond C Peyton
(74) *Attorney, Agent, or Firm* — Studebaker & Brackett PC

(57) ABSTRACT

A cover member of a gas supply manifold has a bent rising wall portion that is formed by bending a part of the cover member so as to rise in an opposite direction of a main body. The bent rising wall portion is in a form of a loop surrounding the entire circumference of a gas supply flow path and an area around the gas supply flow path. Such configuration increases the rigidity of the cover member and prevents large distortion of the cover member and leakage of gas from the gas supply flow path. As a result, the thickness of the cover member is reduced and the weight and the production cost of the gas supply manifold are also reduced.

10 Claims, 6 Drawing Sheets

(56) References Cited

U.S. PATENT DOCUMENTS

| | | | | |
|---|---|---|---|---|
| 2015/0369479 | A1* | 12/2015 | Akagi | F23D 14/586<br>431/354 |
| 2016/0282011 | A1* | 9/2016 | Umakoshi | F24H 1/165 |
| 2017/0184324 | A1* | 6/2017 | Se | B23P 15/26 |
| 2017/0370574 | A1* | 12/2017 | Tsuji | F23D 14/06 |

* cited by examiner

GAS SUPPLY MANIFOLD AND GAS COMBUSTION DEVICE PROVIDED WITH THE SAME

BACKGROUND OF THE INVENTION

Field of the Invention

The present invention relates to a gas supply manifold for use in a constitutional element of a gas powered water heating apparatus and a gas combustion device provided with the gas supply manifold.

Description of the Related Art

Generally, a gas combustion device provided for a gas powered water heating apparatus has a plurality of burner heads (combustion pipes) for burning fuel gas arranged in a burner case and fuel gas is supplied from a gas supply manifold into the burner heads.

The gas supply manifold is disclosed in, for example, Patent Literatures 1 and 2. The gas supply manifold disclosed in these Patent Literatures has a main body provided with a plurality of gas injection nozzles and has a cover member overlapped on the main body via a sealing packing. The cover member constitutes a gas supply flow path between the cover member and the main body and is fastened to the main body with a screw. The cover member and the main body are manufactured by pressing a metal plate.

In such a configuration, the number of members and the production cost of the gas supply manifold are reduced. In addition, the gas supply manifold is made thin and the weight is reduced.

However, there is still room for improvement in the related art as mentioned below.

It is desired that the production cost of the gas supply manifold be further reduced and the weight reduction be further promoted comparing with the related art. For this purpose, the thickness (sheet thickness) of the cover member can be reduced. However, when the thickness is merely reduced, the cover member easily twists and causes deformation such as warp. Such deformation causes leakage of fuel gas out of the gas supply flow path formed between the cover member and the main body. Therefore, there is need for appropriately preventing such problems.

The number of screwed portions of the cover member to the main body can be increased for suppressing warp and deformation of the cover member. In such a case, the screwing procedure becomes complicated and the production cost increases. Further, even when the number of the screwed portions is increased, it is difficult to adequately suppress warp and deformation of the cover member.

CITATION LIST

Patent Literature 1: Japanese Unexamined Patent Application Publication No. 2004-197971

Patent Literature 2: Japanese Unexamined Patent Application Publication No. 2003-065507

SUMMARY OF THE INVENTION

An object of the present invention is to provide a gas supply manifold capable of solving or suppressing the above-mentioned disadvantages and to provide a gas combustion device provided with the gas supply manifold.

In order to solve the above-mentioned problems, the present invention proposes the following technical means.

A gas supply manifold in one aspect of the present invention includes a main body having a plurality of gas injection nozzles, a cover member overlapped on one side of the main body and coupled with the main body, a gas supply flow path formed between the cover member and the main body and communicating with the plurality of gas injection nozzles, and a bent rising wall portion formed by bending a part of the cover member so as to rise opposite to the main body, the bent rising wall portion being in a form of a loop surrounding an entire circumference of the gas supply flow path and an area around the gas supply flow path when viewed in an overlapping direction of the cover member and the main body.

Preferably, the bent rising wall portion is formed so as to entirely overlap the main body when viewed in the overlapping direction.

Preferably, the main body has a plurality of openings for inflow of gas apart from the plurality of gas injection nozzles, and the cover member has a plurality of bulging portions and a non-bulging portion at an area surrounded with the bent rising wall portion, the bulging portions extending toward the plurality of gas injection nozzles from the plurality of openings when viewed in the overlapping direction and bulging in a direction apart from the main body, the non-bulging portion with a flat front face being positioned around the plurality of bulging portions. In addition, each of the bulging portions includes a space constituting the gas supply flow path connecting each of the openings and each of the gas injection nozzles when the cover member is overlapped on the main body in such a manner that the non-bulging portion faces and contacts the one side of the main body.

Preferably, the cover member is manufactured by pressing a metal plate.

Preferably, the main body and the cover member are fastened by a plurality of screwing members.

Preferably, the gas supply manifold further includes a sealing packing interposed between the cover member and the main body, and a convex positioning portion provided for the cover member to be inserted into a hole provided for the sealing packing. The main body has a concave portion that is not penetrated and is dent in a projecting direction of the convex positioning portion through which a tip end of the convex positioning portion goes.

Preferably, the cover member further has a flange portion that is connected with a tip end of the bent rising wall portion and that is bent, the flange portion protruding out of the main body when viewed in the overlapping direction, and the flange portion is used as an attachment portion when the gas supply manifold is attached to an objective attachment member.

Preferably, the gas supply manifold further includes a bent piece integrally connected with the flange portion so as to be bent from an outer peripheral edge of the flange portion.

A gas combustion device in the second aspect of the present invention includes the gas supply manifold of the first aspect of the present invention.

A gas combustion device in the third aspect of the present invention includes a burner case housing a plurality of burner heads, a gas supply manifold facing and contacting an outer face of the burner case, and supplying fuel gas to the plurality of burner heads, and a loop-like sealing packing interposed between the gas supply manifold and the outer face of the burner case. The gas supply manifold proposed in the first aspect of the present invention is used for the gas supply manifold, the flange portion protrudes from an upper part of the main body and from right and left ends of the main body, and a part of the loop-like sealing packing is under the plurality of gas injection nozzles on a front face of the main body and extends in a width direction, and the other of the loop-like sealing packing is on a front face of the flange portion.

The other characteristics and advantages of the present invention are apparent from the following explanation of the preferred embodiments referring to the attached drawings.

BRIEF DESCRIPTION OF THE DRAWINGS

FIG. 1B is incorporated into a burner case.

DETAILED DESCRIPTION OF THE PREFERRED EMBODIMENT

Preferred embodiments of the present invention are explained below with reference to the accompanying drawings.

An arrow Fr in some drawings indicates the forward direction in the following explanation.

Figure 6:
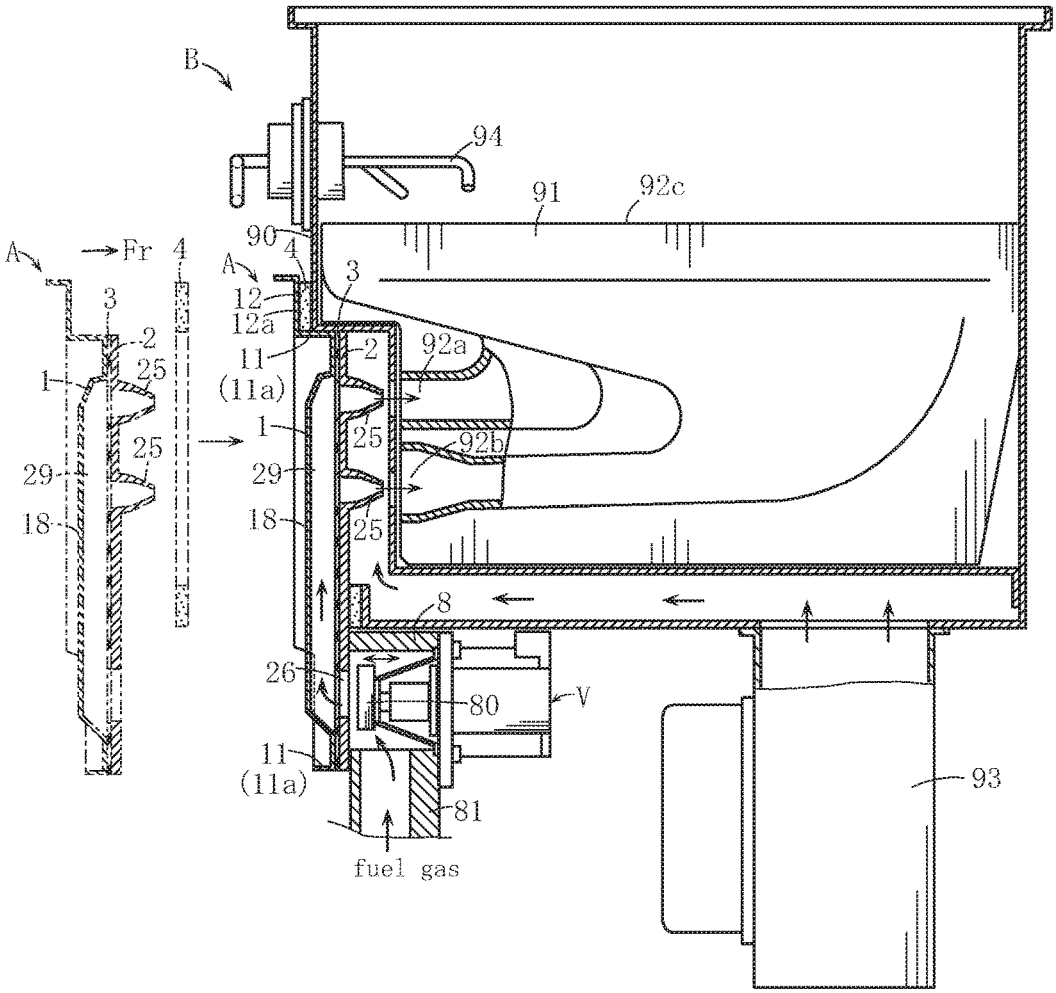
FIG. 6 is an essential sectional view of one embodiment in which the gas supply manifold shown in FIG. 1A

A gas supply manifold A shown in FIG. 1A to FIG. 2C supplies fuel gas to a plurality of burner heads (combustion pipes) 91 housed in a burner case 90 of a gas combustion device B as shown in FIG. 6. Specific structure of the gas combustion device B is explained later.

In FIG. 1A to FIG. 2C, the gas supply manifold A has a main body 2, a cover member 1 overlapped on a rear face of the main body 2, and a sealing packing 3 interposed between the main body 2 and the cover member 1. The main body 2 and the cover member 1 are manufactured by pressing metal plates.

The main body 2 is a nozzle plate, and a plurality of gas injection nozzles 25 projecting in a forward direction of the main body 2 are provided at the upper area of the main body 2. A plurality of gas supply flow paths 29 communicating with the gas injection nozzles 25 are provided between the main body 2 and the cover member 1. Fuel gas is flown into the gas supply flow paths 29 from a plurality of openings 26 provided at the lower area of the main body 2. A plurality of bulging portions 18 are provided so as to form the gas supply flow paths 29, the bulging portions 18 bulging in a direction apart from the main body 2 and being in the form of a stripe when viewed from the back. The bulging portions 18 extend toward the gas injection nozzles 25 from the openings 26, and the inside of each bulging portion 18 constitutes the gas supply flow path 29.

Figure 5A:
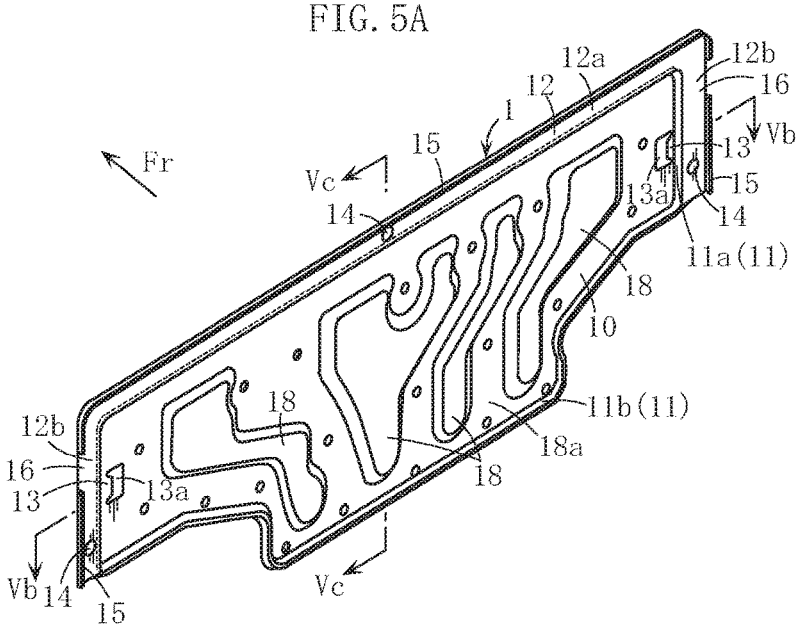
FIG. 5A is a perspective back view of the cover member of the gas supply manifold shown in FIG. 1A and FIG. 1B.
Figure 5C:
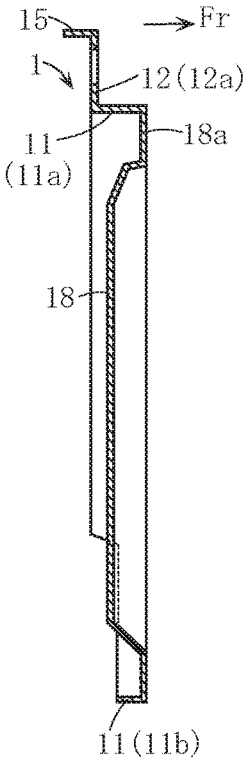
FIG. 5C is a sectional view taken along the line Vc to Vc in FIG. 5A.
Figure 5B:
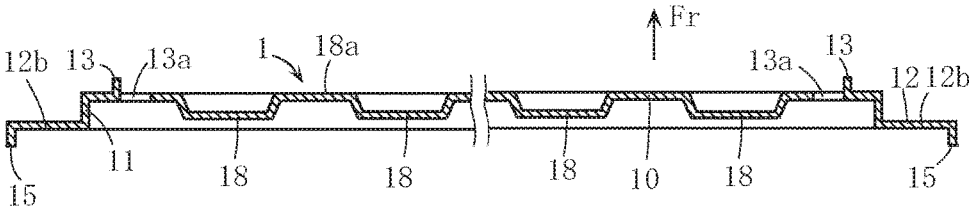
FIG. 5B is a sectional view taken along the line Vb to Vb in FIG. 5A.

The cover member 1 has a bent rising wall portion 11 (11*a*, 11*b*), a flange portion 12, and a pair of convex portions 13 for positioning the sealing packing 3, the convex portions 13 provided on the right and the left, further referring to FIG. 5A to FIG. 5C.

The bent rising wall portion 11 is formed by bending a part of the cover member 1 around the area where the plurality of gas supply flow paths 29 are formed so as to rise toward the back face of the cover member 1 and is in the form of a loop surrounding the entire circumference of the gas supply flow paths 29 and the area around the gas supply flow paths 29 when viewed in the front-rear direction of the cover member 1. The expression "when viewed in the front-rear direction" is one example of "when viewed in the overlapping direction" of the cover member and the main body in the description of the present invention. Specifically, the bent rising wall portion 11 is in the form of a loop similar to the outline of the main body 2 when viewed in the front-rear direction.

Figure 1A:
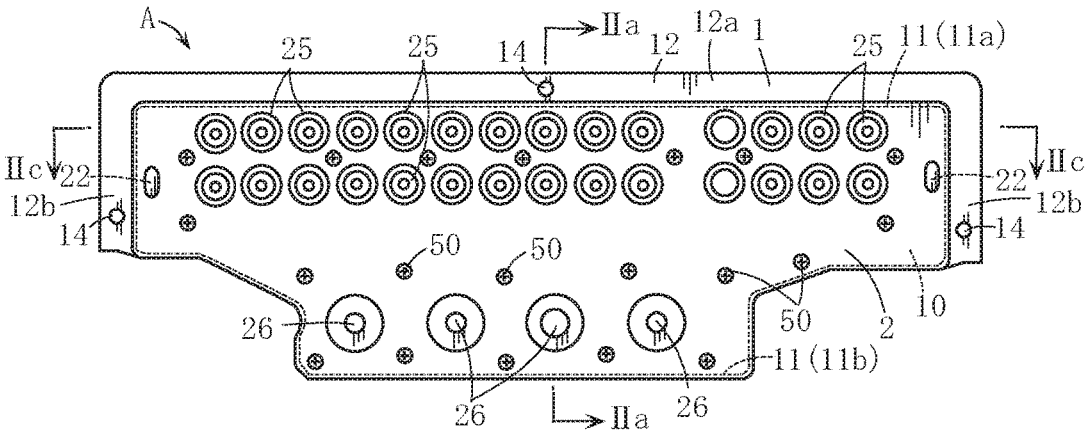
FIG. 1A is a front view of one embodiment of a gas supply manifold of the present invention.
Figure 1B:
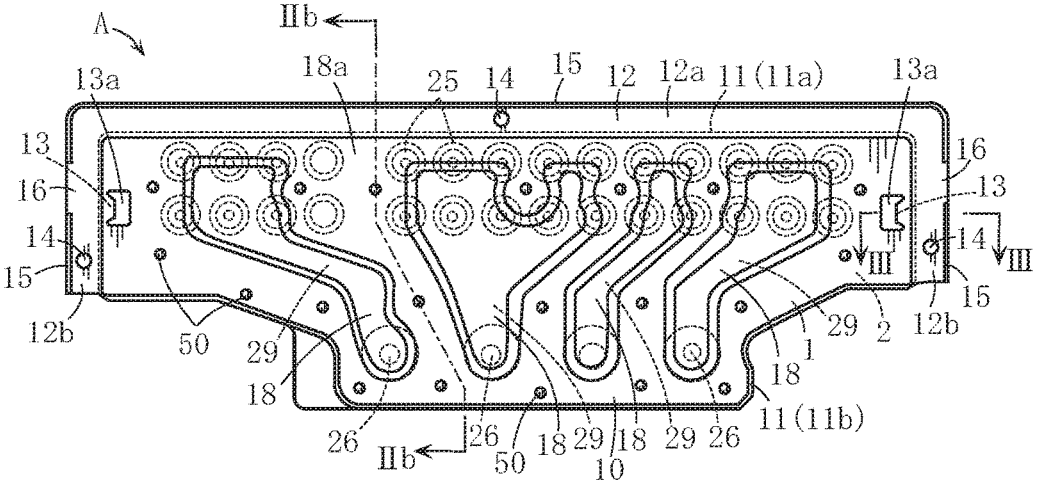
FIG. 1B is the back view.
Figure 2A:
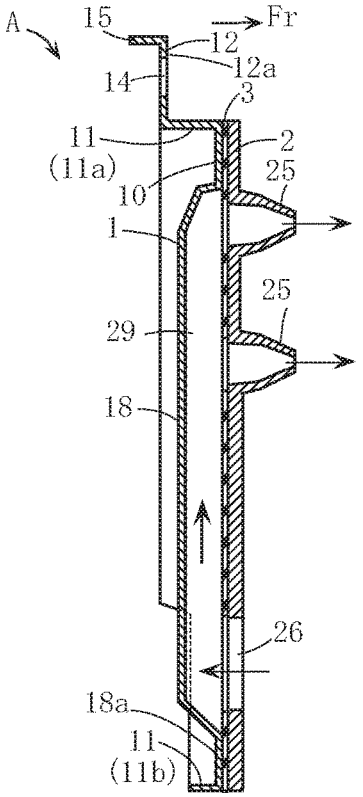
FIG. 2A is a sectional view of the embodiment taken along the line IIa to IIa in FIG. 1A.
Figure 2B:
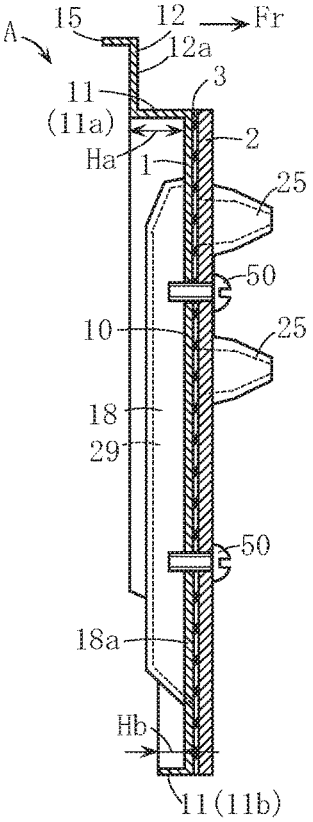
FIG. 2B is a sectional view taken along the line IIb to IIb in FIG. 1B.
Figure 2C:
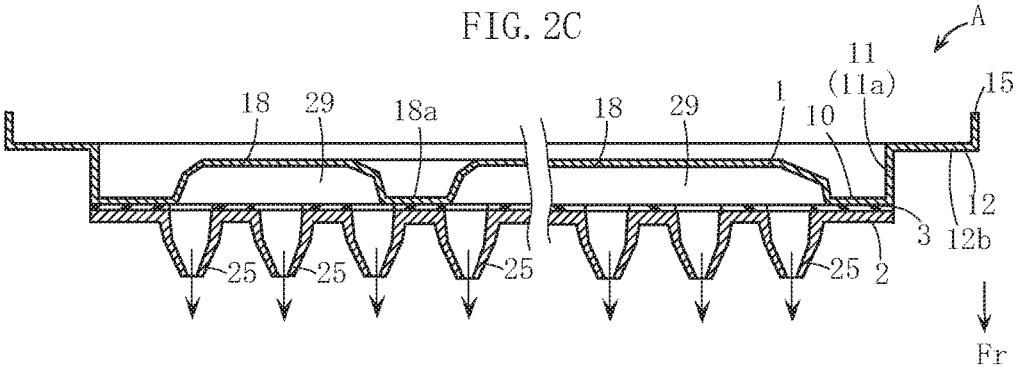
FIG. 2C is a sectional view taken along the line IIc to IIc in FIG. 1A.

The bent rising wall portion 11 is sectioned into an upper bent rising wall portion 11*a* (11) and a lower bent rising wall portion 11*b* (11). The upper bent rising wall portion 11*a* is close to the upper part of the cover member 1, and a tip end of the upper bent rising wall portion 11*a* is connected to the flange portion 12. The lower bent rising wall portion 11*b* is integrally connected with the upper bent rising wall portion 11*a* and is close to the lower part of the cover member 1. In this embodiment, as shown in FIG. 2B, the rising height Ha of the upper bent rising wall portion 11*a* is larger than the rising height Hb of the lower bent rising wall portion 11*b*. However, the present invention is not limited to such an embodiment, and the height Ha can be equal to the height Hb or the height Ha cannot be equal to the height Hb.

The entire loop-like bent rising wall portion 11 approximately overlaps with the main body 2 when viewed in the front-rear direction of the gas supply manifold A. The almost all of the area of the cover member 1 surrounded with the bent uprising wall 11 constitutes an overlapping area 10 overlapped with the main body 2. The overlapping area 10 of the cover member 1 is fastened to the main body 2 by means of a plurality of screws 50 (screwing members). In the area around the plurality of the bulging portions 18 (the area other than the bulging portions 18), a front face of the overlapping area 10 facing the main body 2 basically constitutes a flat non-bulging portion 18*a*. The screws 50 are fastened in such a manner that the non-bulging portion 18*a* faces and contacts the back face of the main member 2 through the sealing packing 3.

Figure 4:
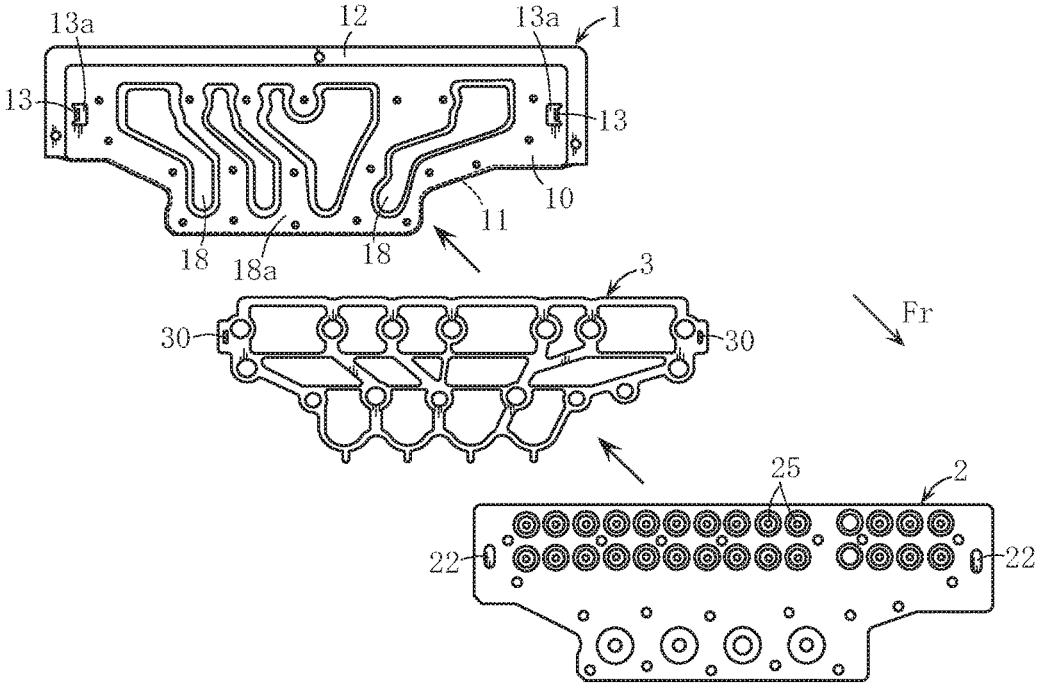
FIG. 4 is an exploded front view of the gas supply manifold shown in FIG. 1A and FIG. 1B.

A pair of convex positioning portions 13 are provided at right and left ends of the overlapping area 10 of the cover member 1 or are provided around the right and left ends. The convex positioning portions 13 are formed by making a hole 13*a* on the cover member 1 and by rising the area around the hole 13*a*, namely a rising process, and projects forward from the cover member 1. For assembling the gas supply manifold A, for example, the packing 3 is mounted on a front face of the cover member 1, then the main body 2 is mounted the packing 3, and all of them are fastened, as shown in FIG. 4. The convex positioning portions 13 are inserted into holes 30 provided at the right and left ends of the packing 3 or around the right and left ends when the packing 3 is mounted on the front face of the cover member 1.

Figure 3:
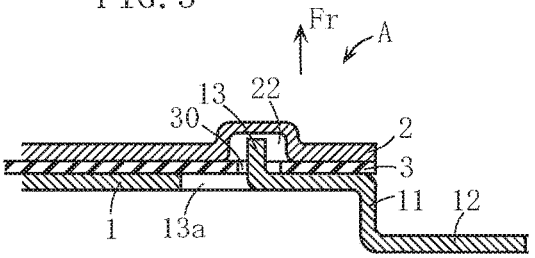
FIG. 3 is an essential sectional view of the embodiment taken along the line III to III in FIG. 1B.

Concave portions 22 dented in a forward direction of the main body 2 are formed on the back face of the main body 2 corresponding to the convex positioning portions 13. As shown in FIG. 3, a tip end of the convex positioning portion 13 goes through the concave portion 22. The concave portion 22 is formed by making a step, namely a step press working, on the main body 2 and is not penetrated.

The flange portion 12 is connected to the tip end of the bent rising wall portion 11 and is bent in a direction intersecting with the bent rising wall portion 11. The flange portion 12 has an upper portion 12*a* protruding from the upper part of the main body 2 and has right-left ends 12*b* protruding from the right and left ends of the main body 2. The flange portion 12 has a plurality of holes 14 for screwing and the gas supply manifold A is attached to an objective attachment portion using the flange portion 12. A bent piece 15 for reinforcing the flange portion 12 is further provided for an outer peripheral edge of the flange portion 12. The outer peripheral edge of the flange portion 12 has an area 16 without having the bent piece 15, and the area 16 works as a portion supporting the cover member 1 when the cover member 1 is manufactured by "a progressive press working".

The gas supply manifold A is used for a constitutional component of the gas combustion device B shown in FIG. 6, for example.

The basic structure of the gas combustion device B is similar to the gas combustion device disclosed in Patent Literature 1 and has the plurality of burner heads 91 arranged in a direction intersecting with the sheet of the figure, the burner case 90 having an upper opening and housing the burner heads 91, a fan 93 for supplying combustion air into the burner case 90 from the lower part of the burner case 90, and an ignition plug 94. When fuel gas and combustion air are mixed and flow in the burner head 91 from gas supply ports 92*a*, 92*b*, the fuel gas burns on a flame bore face 92*c* formed on an upper face of the burner heads 91. When a heat exchanger, not shown, capable of communicating heated water is provided on the burner case 90, water is heated by the gas combustion device B, thereby constituting a gas powered water heating apparatus.

In the gas combustion device B, the gas supply manifold A is set as below. An auxiliary member 8 having a plurality of on-off valves V for supplying fuel gas is provided at a lower part of a front face of the main body 2. Fuel gas supplied from a gas pipe, not shown, flows into the gas supply flow paths 29 through a gas supply flow path 81 in the auxiliary member 8 and through the openings 26 of the main body 2. The on-off valves V are capable of opening or closing the openings 26. The auxiliary member 8 is appropriately provided with a flow control valve and so on, not shown.

The flange portion 12 is screwed to the burner case 90, thereby attaching the gas supply manifold A to an outer face of the burner case 90. In such a case, the plurality of gas injection nozzles 25 face and contact the gas supply ports 92*a*, 92*b* of the burner heads 91 and fuel gas is supplied to the gas supply ports 92*a*, 92*b*.

Figure 7:
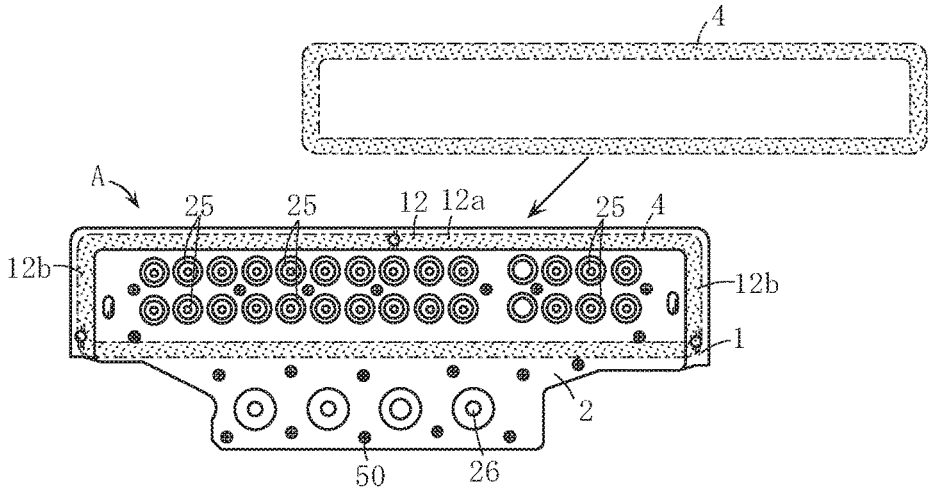
FIG. 7 is a front view of an example when a loop-like sealing packing used in the structure shown in FIG. 6 is attached.

For attaching the gas supply manifold A, a loop-like sealing packing 4 made of an elastic material is used. The loop-like packing 4 is, for example, in the form of a loop that is substantially rectangular when viewed from the front as shown in FIG. 7. A part of the loop-like packing 4 is provided under the plurality of gas injection nozzles 25 on the front face of the main body 2 and extends in the width direction from side to side. The other part of the loop-like packing 4 is positioned on a front face of the flange portion 12 of the cover member 1. A step-like difference is generated between the front face of the flange portion 12 and the front face of the main body 2 in the back-and-forth direction of the gas supply manifold A. The loop-like packing 4 is made of a flexible material and is prepared so as not to produce a gap at the difference.

In the embodiment of FIG. 6 in which the gas supply manifold A is attached, the loop-like packing 4 is positioned so as to surround the entire circumference of the area where the plurality of gas injection nozzles 25 are provided when viewed from the front of the burner case 90 and is compressed between the gas supply manifold A and the burner case 90. Therefore, fuel gas injected from the gas injection nozzles 25 is appropriately prevented from leaking out of the loop-like packing 4.

Next, the functions of the gas supply manifold A and the gas combustion device B provided with the same are explained.

The loop-like bent rising wall portion 11 of the cover member 1 is provided so as to surround the entire circumference of the plurality of the gas supply flow paths 29 and the area around the gas supply flow paths 29, thereby increasing the strength of such an area. Different from the embodiment of the present invention, if the cover member 1 is partially provided with a non-loop bent rising wall portion, it is difficult to efficiently reinforce the wide area including and around the gas supply flow paths 29 and the cover member 1 may be warped and deformed. On the other hand, in the present invention, there is such an advantage that the loop-like bent rising wall portion 11 eliminates warping and deformation of the cover member 1, and eliminates distortion of the gas supply flow paths 29 and the area around the gas supply flow paths 29.

Figure 8:
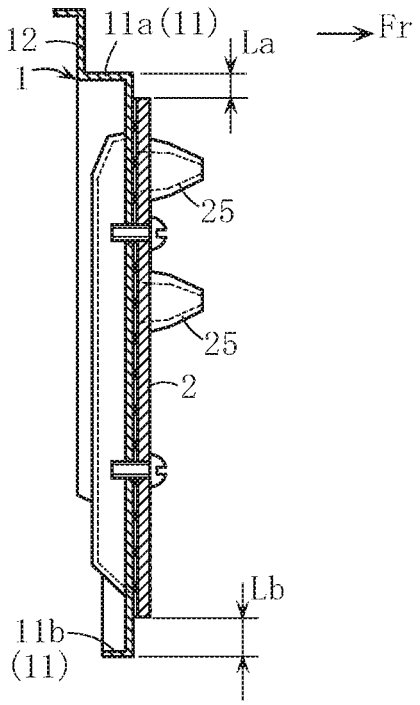
FIG. 8 is a sectional view of a comparison example relative to the embodiment shown in FIG. 1A.

The entire loop-like bent rising wall portion 11 approximately overlaps with the main body 2 when viewed in the front-rear direction, thereby efficiently reinforcing the gas supply flow paths 29 and the area around the gas supply flow paths 29. FIG. 8 illustrates a comparison example with the embodiment of the present invention, and the upper and lower bent rising wall portions 11*a*, 11*b* (11) protrude from the main body 2 in appropriate widths La, Lb. This comparison example is included in the technical field of the present invention. However, in the comparison, the bent rising wall portion 11 with high rigidity does not strongly contact the main body 2 under pressure. On the other hand, in the embodiment of the present invention, the bent rising wall portion 11 with high rigidity is able to strongly contact the main body 2 under pressure. In addition, the dimension of the area surrounded with the loop-like bent rising wall portion 11 is smaller than that of the comparison. Therefore, in the embodiment of the present invention, the gas supply flow paths 29 and the area around the gas supply flow paths 29 are further effectively reinforced.

As mentioned above, even when the thickness of the cover member 1 is comparatively reduced, large distortion is not caused around the gas supply flow paths 29 of the cover member 1 and the area around the gas supply flow paths 29, and the main body 2 and the cover member 1 do not generate the gap causing gas leakage from the gas supply flow paths 29. In addition, there is no need for increasing the number of the screwing portions for fastening the cover member 1 and the main body 2 in order to prevent gas leakage. Therefore, the weight and production cost of the gas supply manifold A are reduced, and further the weight and production cost of the gas combustion device B are appropriately reduced.

As shown in FIG. 3, the projecting dimension of the convex positioning portion 13 is made larger than the thickness of the packing 3 since the convex positioning portion 13 goes through the concave portion 22 of the main body 2. That fact is preferable to prevent the positioning convex portion 13 from coming off the holes 30 of the packing 3 and to improve assembly performance of the packing 3 when the packing 3 is assembled to the cover member 1. On the other hand, the concave portion 22 of the main body 2 is a non-penetrating hole and gas does not leak out through the concave portion 22.

In this embodiment, as explained referring to FIG. 6 and FIG. 7, the flange portion 12 of the cover member 1 is used for attaching to the burner case 90, so that there is no disadvantage such that the attachment performance of the gas supply manifold A is deteriorated due to the fact that the cover member 1 is provided with the loop-like bent rising wall portion 11. The loop-like packing 4 appropriately prevents leakage of fuel gas injected from the plurality of the gas injection nozzles 25. The loop-like packing 4 is preferably positioned on the front face side of the flange portion 12 and the main body 2.

The present invention is not limited to the above-mentioned preferred embodiments. The concrete configuration of the members of the gas supply manifold and the gas combustion device in the present invention is freely designed within the intended scope of the present invention.

The specific configuration (loop-like shape) and specific rising dimension of the bent rising wall portion in the present invention are not limited.

It is not limited that the cover member and the main body are fastened by a screw. They can be fastened by means of a screwing member other than a screw. In place of or in addition to the screwing member, a caulking means can be used.

The gas combustion device of the present invention is not limited to a gas powered water heating apparatus and can be used for heating or incinerating. The specific usage is not limited.

The invention claimed is:

1. A gas supply manifold comprising:

a main body having a plurality of gas injection nozzles;

a cover member overlapped on one side of the main body and coupled with the main body;

a gas supply flow path formed between the cover member and the main body and communicated with the plurality of gas injection nozzles; and a bent rising wall portion formed by bending a part of the cover member so as to rise opposite to the main body, the bent rising wall portion being in a form of a loop surrounding an entire circumference of the gas supply flow path and an area around the gas supply flow path when viewed in an overlapping direction of the cover member and the main body, wherein the cover member includes a flange portion that protrudes from the upper side and left and right sides of the main body, the bent rising wall portion includes an upper bent rising wall portion and a lower bent rising wall portion, the upper bent rising wall portion including an upper portion and a pair of left and right side portions, respectively, located on the upper side and the left and right sides of the gas supply flow path and the area around the gas supply flow path, the upper bent rising wall portion connects a part of the cover member around the area where the plurality of gas supply flow paths are formed to the flange portion, a step-like difference is generated between flange portion and the part of the cover member around the area where the plurality of gas supply flow paths are formed, the lower bent rising wall portion is located under the gas supply flow path and the area around the gas supply flow path and the flange portion is not formed at a peripheral edge of the lower bent rising wall portion, the upper bent rising wall portion is located above and on the left and right sides of the gas supply flow path and the area around the gas supply flow path and the flange portion is formed at a peripheral edge of the upper bent rising wall portion; and both ends of the lower bent rising wall portion are integrally connected to lower end portions of the pair of left and right side portions of the upper bent rising wall portion.

2. The gas supply manifold as set forth in claim 1, wherein the bent rising wall portion is formed so as to entirely overlap the main body when viewed in the overlapping direction.

3. The gas supply manifold as set forth in claim 1, wherein the main body has a plurality of openings for inflow of gas apart from the plurality of gas injection nozzles, the cover member has a plurality of bulging portions and a non-bulging portion at an area surrounded with the bent rising wall portion, the bulging portions extending toward the plurality of gas injection nozzles from the plurality of openings when viewed in the overlapping direction and bulging in a direction apart from the main body, the non-bulging portion with a flat front face positioned around the plurality of bulging portions, and each of the bulging portions includes a space constituting the gas supply flow path connecting each of the openings and each of the gas injection nozzles when the cover member is overlapped on the main body in such a manner that the non-bulging portion faces and contacts the one side of the main body.

4. The gas supply manifold as set forth in claim 1, wherein the cover member is manufactured by pressing a metal plate.

5. The gas supply manifold as set forth in claim 1, wherein the main body and the cover member are fastened by a plurality of screwing members.

6. The gas supply manifold as set forth in claim 1, further comprising:

a sealing packing interposed between the cover member and the main body; and a convex positioning portion provided for the cover member to be inserted into a hole provided for the sealing packing, wherein the main body has a concave portion that is not penetrated and is dent in a projecting direction of the convex positioning portion through which a tip end of the convex positioning portion goes.

7. The gas supply manifold as set forth in claim 1, wherein the cover member further has a flange portion that is connected with the peripheral edge of the bent rising wall portion and that is bent, the flange portion protruding out of the main body when viewed in the overlapping direction, and the flange portion is used as an attachment portion when the gas supply manifold is attached to an objective attachment member.

8. The gas supply manifold as set forth in claim 7, further comprising a bent piece integrally connected with the flange portion so as to be bent from an outer peripheral edge of the flange portion.

9. A gas combustion device comprising the gas supply manifold as set forth in claim 1.

10. A gas combustion device comprising:

a burner case housing a plurality of burner heads;

a gas supply manifold as set forth in claim 1 facing and contacting an outer face of the burner case, and supplying fuel gas to the plurality of burner heads; and a loop-like sealing packing interposed between the gas supply manifold and the outer face of the burner case, the flange portion protrudes from the upper side of the main body and from right and left sides of the main body, and a part of the loop-like sealing packing is under the plurality of gas injection nozzles on a front face of the main body and extends in a width direction, and the other of the loop-like sealing packing is on a front face of the flange portion.

* * * * *